US007515164B2

(12) United States Patent
Patrik

(10) Patent No.: US 7,515,164 B2
(45) Date of Patent: Apr. 7, 2009

(54) MONITORING AND ADJUSTING WEB IN A PRINTING PRESS

(75) Inventor: Shawn Patrik, Chatsworth, CA (US)

(73) Assignee: Pharmaceutic Litho & Label Company, Inc., Chatsworth, CA (US)

( * ) Notice: Subject to any disclaimer, the term of this patent is extended or adjusted under 35 U.S.C. 154(b) by 378 days.

(21) Appl. No.: 11/313,611

(22) Filed: Dec. 21, 2005

(65) Prior Publication Data

US 2006/0150853 A1 Jul. 13, 2006

Related U.S. Application Data

(60) Provisional application No. 60/705,358, filed on Aug. 4, 2005, provisional application No. 60/638,719, filed on Dec. 23, 2004.

(51) Int. Cl.
*B41J 11/00* (2006.01)

(52) U.S. Cl. ..... 347/221; 101/485

(58) Field of Classification Search ..... 347/221; 101/485

See application file for complete search history.

(56) References Cited

U.S. PATENT DOCUMENTS 6,432,500 B1 * 8/2002 Jones et al. ..... 428/40.1
2005/0067106 A1 * 3/2005 Melges ..... 156/367

* cited by examiner

*Primary Examiner*—Huan H Tran
(74) *Attorney, Agent, or Firm*—Colin P. Abrahams

(57) ABSTRACT

A printing press machine for processing a web roll of labels, the printing press machine comprises a mark sensor at a predetermined location along the printing press machine for sensing the presence of a mark formed on each label on the web roll, the mark being at substantially the same position on each label on the web roll. A speed sensor is provided for sensing the position of at least one gear on or associated with the printing press machine to determine the speed at which the web roll of labels moves through the printing press machine. A control member monitors and adjusts where necessary the speed of the printing press machine so as to regulate the speed of the web roll as it moves through the printing press by co-ordinating the information received from the mark sensor and the speed sensor so that a label on the web roll will be properly positioned at a selected station of the printing press machine for attachment of a device to the label at the station.

20 Claims, 7 Drawing Sheets

MONITORING AND ADJUSTING WEB IN A PRINTING PRESS

CROSS REFERENCE TO RELATED APPLICATIONS

This application claims the benefit of U.S. Provisional Patent Applications Nos. 60/638,719 filed Dec. 23, 2004 and 60/705,358 filed Aug. 4, 2005, both of which are incorporated herein by reference in their entirety.

FIELD AND BACKGROUND OF THE INVENTION

This invention relates to labels with adhesive attached booklets mounted thereon and the processes and devices for creating such a label. The adhesive may be a spot applied to the surface of the label or it may be of any desired shape and/or size.

A wide variety of different forms, shapes and configurations of labels for multiple purposes are well known in many industries and having many applications. In some fields of activity, specific types of labels are required to meet certain needs and disclosure requirements. As an example of such an activity, containers or bottles for pharmaceuticals, drugs and/or over-the-counter medicines may require by law or regulation that certain information pertinent to the contents of the container be disclosed on the container to the ultimate or end user. Further, in hospital settings, other labels may require slings or hangers or suspension mechanisms for inverting a container to which the label is attached such as a bottle in certain applications, such as for use in association with intravenous feed tubes.

Still other types of labels may require peel-off or supplemental portions as a component thereof that can be removed by the end user, with information printed thereon. Such a peel-off portion may either be discarded after reading and use, or it may be used or re-used in certain manners. In this regard, a peel-off section of a label may, for example, be used for placement on a patient's medical chart in a hospital setting as evidence that a certain medication was administered or procedure performed. Such a section of the label thus becomes part of the medical record of the patient, and can represent a shorthand, expeditious and convenient mechanism for entering and recording information.

SUMMARY OF THE INVENTION

According to one aspect of the invention, there is provided a method of monitoring the position of a web roll of labels in a printing press machine having at least one gear, the method comprising: forming a mark on each label on the web roll, the mark being at substantially the same position on each label on the web roll; sensing the presence of the mark by means of a mark sensor at a predetermined location; sensing the position of the at least one gear by means of a speed sensor to determine the speed at which the web roll of labels is moving through the printing press machine; and monitoring and adjusting where necessary the speed of the web roll as it moves through the printing press by co-ordinating the information received from the mark sensor and the speed sensor so that a label on the web roll will be properly positioned at a selected station of the printing press machine for attachment of a device to the label at the station.

Preferably, the device attached to the label at the station comprises a booklet. Further, the mark may comprise a solid dark indicator printed on the label and the mark sensor comprises an optical sensor for sensing the presence of the indicator.

In one form, the speed sensor measures the rate of rotation of the gear, and the method further comprises calculating the speed of the movement of the web roll through the printing press machine based on the speed of rotation of the gear. The speed sensor and gear may together comprise an electronic encoder.

Preferably, the speed sensor is connected to a booklet applicator system, and the booklet applicator system dispenses booklets for attachment to the label when the web roll is properly positioned so that the booklet is located on the label in a predetermined position. Glue or adhesive may be placed on the label for attaching the booklet to the label in the predetermined position. Further, there may be a release layer over at least a portion of the adhesive In one embodiment, the monitoring and adjusting includes slowing down or increasing the speed of the web roll as it moves through the printing press machine in response to information obtained from the mark sensor or the speed sensor.

A hanger may be placed on the label prior to attachment of the device to the label, the hanger comprising a connector strip fastened to the label and a hanger portion attached to the connector strip but not directly to the label. Further, the booklet may be arched on the label to account for curvature of a bottle on which the label may be mounted.

According to another aspect of the invention, there is provided a system for monitoring the position of a web roll of labels in a printing press machine having at least one gear, the system comprising: a mark formed on each label on the web roll, the mark being at substantially the same position on each label on the web roll; a mark sensor at a predetermined location along the printing pres machine for sensing the presence of the mark; a speed sensor for sensing the position of the at least one gear to determine the speed at which the web roll of labels is moving through the printing press machine; and a control member for monitoring and adjusting where necessary the speed of the web roll as it moves through the printing press by co-ordinating the information received from the mark sensor and the speed sensor so that a label on the web roll will be properly positioned at a selected station of the printing press machine for attachment of a device to the label at the station.

According to yet a further aspect of the invention, there is provided a printing press machine for processing a web roll of labels, the printing press machine comprising: a mark sensor at a predetermined location along the printing press machine for sensing the presence of a mark formed on each label on the web roll, the mark being at substantially the same position on each label on the web roll; a speed sensor for sensing the position of at least one gear on or associated with the printing press machine to determine the speed at which the web roll of labels moves through the printing press machine; and a control member for monitoring and adjusting where necessary the speed of the printing press machine so as to regulate the speed of the web roll as it moves through the printing press by coordinating the information received from the mark sensor and the speed sensor so that a label on the web roll will be properly positioned at a selected station of the printing press machine for attachment of a device to the label at the station.

The invention may further comprise a booklet applicator for dispensing and applying a booklet to the label on the web roll when properly positioned at the selected station. Further, an adhesive dispenser may be provided for dispensing adhesive to the label on the web roll, the adhesive facilitating adhesion of the booklet to the label. Still further, a hanger station may be provided for applying a hanger to the label on the web roll prior to application of the booklet.

Preferably, the speed sensor measures the rate of rotation of the gear for calculating the speed of the movement of the web roll through the printing press machine based on the speed of rotation of the gear. An encoder gear may be operatively connected to the at least one gear, the encoder gear comprising the speed sensor to determine the speed of the web roll.

According to still a further aspect of the invention, there is provided a printing press machine for applying a booklet to a label on a web roll of labels, the printing press machine comprising: a mark sensor at a predetermined location along the printing press machine for sensing the presence of a mark formed on each label on the web roll, the mark being at substantially the same position on each label on the web roll; a speed sensor for sensing the position of at least one gear on or associated with the printing press machine to determine the speed at which the web roll of labels moves through the printing press machine; a booklet applicator for dispensing and applying a booklet to the label on the web roll; and a control member for monitoring and adjusting where necessary the speed of the printing press machine so as to regulate the speed of the web roll as it moves through the printing press by co-ordinating the information received from the mark sensor and the speed sensor so that a label on the web roll will be properly positioned at a selected station of the printing press machine for attachment of a booklet to the label at the station.

In one particular form, many labels of the invention are manufactured such as on a continuous web or on a liner from which they can be conveniently removed when needed, each label containing certain disclosures and information, and a booklet of some sort placed over the label by means of an adhesive mechanism, so that it can be removed, as appropriate, either on a permanent basis, or fully or partly peeled off and folded back from the label and then re-adhered thereto for future reference as well.

This particular invention relates to labels having a booklet of some configuration placed over a label. The booklet may be in the form of a series of pages arranged in typical book format, or the booklet may be comprised of one or more elongate strips of paper or other material folded back and forth along itself to create a booklet-type structure. In any event, whatever form the booklet may take, it is placed over an existing label, for example, to provide additional information to that which can conveniently be placed on a typical label, but is done so in a manner which is releasable so that the booklet can easily be removed at the appropriate time, and, in certain circumstances, re-applied for future use.

Many different forms and procedures are known for forming the label alone, or forming a simple label in conjunction with some mechanism or process whereby the booklet is also placed over the label.

Certain labels with booklets mounted thereon use what is often known as an "encoder" mechanism for placing the booklet on an existing label. In one particular example, an encoder may be a box or other type of housing which may contain a sensor that may be focused on the gear or other component of a printing press, which may be rotating as the label web moves through the printing press or machinery. The sensor is able to read or determines the revolutionary progress and position of the gear. The accomplishment of accurate booklet placement is based upon information provided through sensing of the sensor that, with every revolution of, for example, a gear, a certain distance and length, such as a specified number of inches, of web or label has been moved linearly along the press. Such a system would be programmed to place a booklet, as an example only, every four inches, which may be the circumference of the gear. (Distances other than the circumference of the gear can of course be used.) Either way, the sensor determines the progress of revolution of the gear, and can calculate therefrom whether a certain preselected distance, such as a 4-inch spacing, has passed, so that a booklet can be laid down upon a label at every 4-inch or other predetermined regular interval.

The present invention, in one aspect, comprises a web sensor, which may in one embodiment comprise a light barrier sensor. Such a web sensor may sense the area or points between successive labels mounted on a web or liner moving through a printing press, and is able to calculate the distance to be moved after sensing such gap, for example on a time basis, for the purpose of thereby placing the booklet at the appropriate location on the label.

In one form, therefore, the present invention relates to the placement of a booklet on a label, for example, a sling or hanging label, by applying the booklet to the label using an adhesive which is placed on the upper surface of the label. The adhesive adheres to both the upper surface of the label, as well as the undersurface of the booklet mounted thereon, so that the booklet is held in position, but can be releasably removed therefrom by a user.

The booklet may be applied on the label in several ways. One such mechanism for applying the booklet to the label is to do it in line, namely, by producing a label, such as sling label, and then placing the booklet on top of the sling in the same run. The sling label is typically produced by cutting a solid label layer on a liner into the shape and form desired, and then removing the waste or unusable part of the label layer to leave the desired label only.

Another approach to the proper placement of a booklet on a label would be through web detection. In this way, the label, such as a sling label, may be produced, as a series of labels along an elongate liner or web, and then, after a first run, placed back on the printing press. An opacity sensor, for example, may be used as the registration system for determining the precise location of the label in the printing press for calculating the proper and accurate placement of the booklet over the label.

In accordance with the present invention, web sensing equipment is used to either print, deposit or otherwise place a release coat at a particular point on the label. Once this release coat, and subsequent placement of glue or adhesive thereon, is formed on the label, the booklet can then be placed thereover in a subsequent manufacturing step, and will adhere to the label so that a label/booklet combination is formed.

In accordance with one aspect of the invention, there is therefore provided a label and a mechanism for producing the label with a booklet, which first involves the production of a series of labels, such as hanging or sling labels. Thus, a liner with a solid layer which will form the label is run through a press, and the label is cut or dye-cut in a conventional fashion so as to have the necessary dimensions, configuration and components of the desired label.

The elongate web is then preferably rewound and put back through the press for the purposes of installing a booklet on each of the labels.

On the second take or run through the press, the web with the pre-cut labels thereon passes through a web-sensing unit, the purpose of which is to place a release coat at predetermined and desired portions on the upper surface of the label. Thereafter, preferably at the next station, also using either web sensor or an encoder, an adhesive, or glue, is placed on top of the release coat. The purpose of the release coat is to ensure that, once the booklet has been applied, the adhesive and release coat will be sufficiently strong to hold the booklet on the label, but at the same time enable the booklet to be removed by peeling it off the label, without damaging either the booklet or the label during separation due to any of the adhesive qualities.

Thereafter, once more using either an encoder or a web sensor, the booklet is placed at the appropriate intervals over the label, in such a manner that the adhesive, mounted on top of the release coating, fastens to the underside of the booklet and keeps it in position over the label.

In accordance with one aspect of the invention, the procedure involves the use of a web sensor for determining the precise location of a web, containing pre-cut labels, so that a release coat can be deposited thereon at the appropriate locations, and an adhesive can thereafter be placed on the release coat.

The adhesive can be "printed" on the release coat, or it can be applied by other means, such as by "shooting" a small quantity of the adhesive onto the release coat which has been applied to the upper surface of the label.

A first sensing unit may be provided for the purposes of establishing the precise location where the release coat is to be applied, while another sensing unit which may be downstream of the first is employed for the purposes of ascertaining and determining the correct place on the label on which to place the adhesive, namely, on and over the previously applied release coat.

Once the release coat and adhesive have been applied, the booklet can be placed and fastened to the label. This can be done using the "encoder" process, which may sense revolutions of gear mechanisms. Alternatively, other or additional mechanisms for determining the location of a label with respect to the press can be utilized, or the system may also use the web sensor process, as described above.

An advantage the re-registration process in accordance with one aspect of the invention ensures that both the release coating and the adhesive conform and register with each other, and are accurately placed, bearing in mind other configurations already on the label, such as a sling. The adhesive and release coating can be applied taking into account, for example, a fold out sling or hanger on the label so that it will not interfere with the potential operation and functions of the sling.

One aspect of the present invention, in one embodiment thereof, is one for producing, amongst other things, a sling label. In the procedure for producing the label, the web matrix or waste need not be removed.

In a first pass of stage in the manufacture of the label, the basic procedure and steps for producing the sling label occurs. This involves the preparation of the base material which comprises a liner, and an adhesive-backed material thereon. The invention may start with this, and the base material is run through a printing pass. During printing, a printing reference point, or an "eye mark" is made, for future reference, as will be described more fully below. A release coat is applied on the upper surface of the adhesive-backed material, over most of the area thereof. The purpose of this adhesive-backed material is to permit the proper application of an overlam, which is applied later, to be peeled off quite easily.

Thereafter, the hanger is formed on the base material. A stock of clear hanger material having a hanger portion and a connector strip is applied and a deadening adhesive is formed on the adhesive of the hanger portion. The adhesive, however, is permitted to remain and operate on connector strips by means of which the hanger will become permanently secured to the bracket or holder on which the hanger is eventually mounted. A previously applied release coat is not applied to the area where the connector strip will be. Thereafter, a die-cutting step occurs to cut out the shape of a hanger and the waste is removed. This leaves the hanger free to move toward and way from the label in pivotal fashion, and the connector strip is adhered to the base forming the anchor for the hanger.

At this point, the end of the first pass has occurred. In the first pass, the waste from the base material is not, or does not have to be, removed as distinguished from waste from the hanger material, which is preferably removed. After the first pass, the label is then ready for inspection, and is checked to ensure that the hanger is properly formed, and the integrity of the printing meets required standards. Such an inspection will usually but not necessarily be done by an individual.

The roll stock is then rewound and further inspection by an individual may occur during the rewinding in an attempt to spot defects. Any defective or unacceptable areas along the roll, which has now gone through the first phase, can be cut out and removed, and the cut end then spliced together for future use, as will be described.

The "eye mark" as mentioned above, has particular relevance and importance in the second pass which is now ready to take place. The "eye mark" in one form of the invention is not used to place the booklet itself, but to re-register and monitor the position of the web during the second pass. The "eye mark" can be positioned anywhere on the roll, as long as it is consistently in the same place on each of a series of labels.

The roll is then ready for the commencement of the second pass, which comprises the booklet application. The first step in this second pass is to have the web re-registration equipment, or unit, intact. The re-registration equipment has a sensor, preferably an optical sensor, which gives off a "light bar". The purpose of the sensor is to "look for" or monitor the position of the plurality of "eye markers" printed on each label along the roll, as described above. After finding one of the "eye marks", the sensor then sends pulses or signals to a servo motor which has the ability to effect tightening or loosening of the web. In other words, the motor adjusts the web tension, for the purposes of re-registering the web. In the context of this invention, in one aspect thereof, re-registering of the web means that the web, and each of the labels thereon, is in a particular location at a particular station. The re-registration of the web or roll synchronizes the pre-printed material to the rotation and configuration of the press machine. As a result thereof, the web is properly placed and synchronized from this point on as it moves through the second pass.

It should be noted that the re-registration occurs on an ongoing basis. Every "eye mark" on each of the labels is checked by the sensor, as it passes the sensor, and adjustments are made continuously to ensure constant registration between the web and the machinery. The continual monitoring of the "eye mark" controls the tension of the web as it moves through the machine, and ensures that the web is properly located and positioned at all times for the purposes of applying the book, to be described.

An optional step may, at this point, be the application of a release coat to the end of the connector strip where the overlam will be placed. If this step is not followed, it is possible that the overlam could adhere more strongly than is desired.

The next step involves the booklet application, executed by a booklet applicator machine or station or leaflet applicator machine or station, the latter of which may be preferred. The applicator machine dispenses a booklet or leaflet to an overlaminate. The machine thus dispenses a leaflet on an unwinding laminate. It passes through nip rollers, which connect an upper surface of the leaflet to the laminate, which has an adhesive layer. Please see FIG. 30 of the drawings.

Another mechanism for applying the leaflet to the web is by gluing or using an adhesive. This is done by printing an adhesive area on the upper surface on each of the labels on the web that the booklet will be applied to. The web material comes through the machine, and a leaflet or booklet is placed on top of it. It is either fastened by the over-laminate, or by a glue/adhesive which may be printed or applied to the upper surface of each label.

If the over-laminate process is used, then, if the booklet is to go around a bottle, for example, the booklet needs to be pre-arched. This may be accomplished by over feeding the laminate material to accommodate and thereby create the necessary curvature. Thus, in effect, slightly more laminate than needed for the length of the bottle is fed. The amount of additional length can be adjusted according to the curvature/size of the bottle for which the label is intended, so that the appropriate degree of curvature may be accomplished.

In the application of the booklet, and at the station of the machine applying the booklet at the second pass, there is an encoder. The encoder monitors the circular or angular position, speed and rotation of a selected gear on the press. It should be noted that the encoder can get the appropriate information from any gear along the press. For example, if a booklet is to be dispensed every seven inches, this can be measured based on the size and rotation of the selected gear monitored by the encoder. Note that seven inches is an example only, and any appropriate distance, depending upon the size of the label and booklet, fall within the scope of the invention.

The encoder senses the position of the selected gear with which it is associated. The gear is, of course, connected to and associated with the timing of the press. Further, the web is moving through the press at a selected speed, and is timed with the press due to the functioning of the sensor.

As a general rule, on a single pass, everything is mechanically timed so that it is not necessary for the machine to monitor constantly the position of the web, although this may be done manually, and adjustments effected.

During the second pass, it is necessary to monitor and set the web in its position and movement, as it moves through the press. This is done by the sensor which may be at the beginning of the run of the press.

In essence, the re-register unit described above is timing the web to the printing press as the web moves through the printing press. Further, the encoder is timed to the printing press as well. As a result, it will be appreciated that the printing press is the link between the sensor (i.e. sensing of the "eye mark") and the encoder (i.e. sensing of the selected gear position). The sensor times the printing on the web to the printing press. As such, the printing press has a speed and rotation, or timing. The encoder relies on the consistency of the timing of the web with the press.

The final shape of the label is die-cut, and this can occur through the booklet part of the composite label, and the cut may be carried out on the base material. Waste is then removed.

The booklet is preferably glued onto the web. An adhesive is applied at a printing station on the press by a unit that dispenses adhesive. The unit would have an encoder, or be associated with an encoder, so that glue can be applied to the appropriate point of the web to ensure application of the booklet on the desired position on the label on the web. The glue may be in the form of spots, bars, or any other desirable shape having the necessary effect of facilitating the application of the booklet onto the label.

The "eye mark" itself can be any size or shape. The sensor can be made to read any mark, and the mark would preferably be consistent in its form and shape and recurring along the web at the preset intervals, to ensure that the web is properly positioned in the press.

The invention provides, in one aspect, a booklet having an overlam which is placed over a sling label. The booklet in conjunction with the hanger label, in accordance with the invention, provides an effective mechanism for labeling and providing information for use on a bottle or other container.

DETAILED DESCRIPTION OF THE INVENTION

The application will be described in further detail with reference to drawings and diagrammatic representations accompanying this application. As described above, the process of the invention involves two passes.

Figure 1:
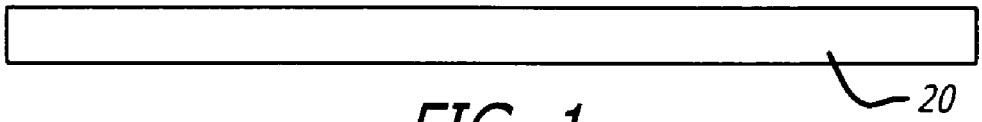
FIGS. 1 to 4 of the drawings show a schematic representation of the basic steps for applying a booklet to a label.

FIGS. 1 to 4 of the drawings show, in schematic form, the basic sequential process for forming a label and booklet combination in accordance with one aspect of the invention. In FIG. 1 of the drawings, there is shown a cross-section or side view of a label 20. The label 20 has a width and is shown, for diagrammatic purposes, as thicker than it is in actuality.

Figure 2:
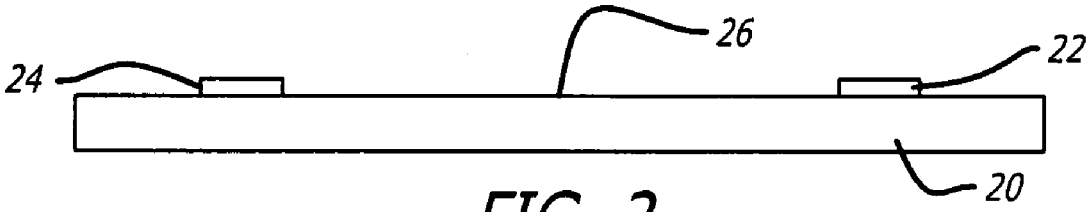

In FIG. 2, release coatings 22 and 24 have been applied to the upper surface 26 of the label 20. The release coatings 22 and 24 are placed in position, so as to avoid placement over a sling or other configuration on the upper surface 26 of the label, for improved use.

Figure 3:
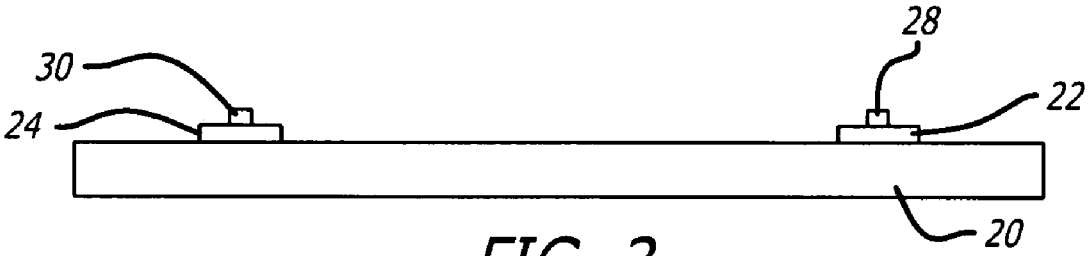

In FIG. 3, there is shown an adhesive 28 and 30, which is formed on the release coatings 22 and 24 respectively. The adhesive spots 28 and 30 are deposited at substantially precise locations, such as by a printing mechanism, or by shooting them, as one would discharge ink from an inkjet printer, using a web or encoder system.

Figure 4:
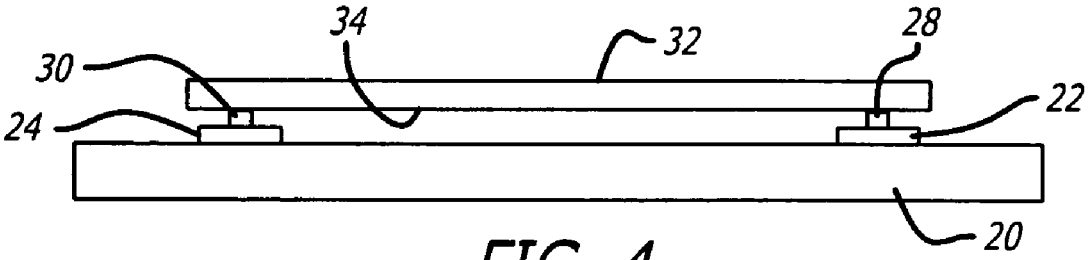

In FIG. 4, a booklet 32 is placed over the label 20, and the undersurface 34 of the booklet adheres at certain points corresponding to the adhesive 28 and 30.

As will be described below, the proper placement of the booklet 32 is achieved by controlling and monitoring a web with a series of labels thereon as it passes through a printing press.

First Pass

Figure 5:
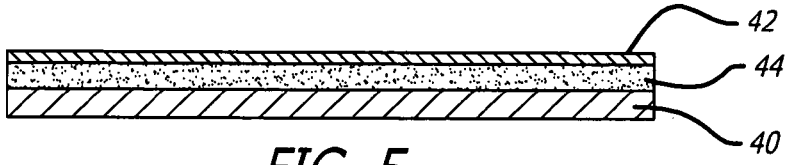
FIGS. 5 to 30 show steps and embodiments of the invention whereby a booklet or other device may be located on a label in a printing press.

The first step during the first pass relates to the substrate construction, also referred to as the base material or base stock. In FIG. 5, there is shown the substrate construction comprising a liner 40, and a face stock 42 with an adhesive layer 44 therebetween.

Figure 6:
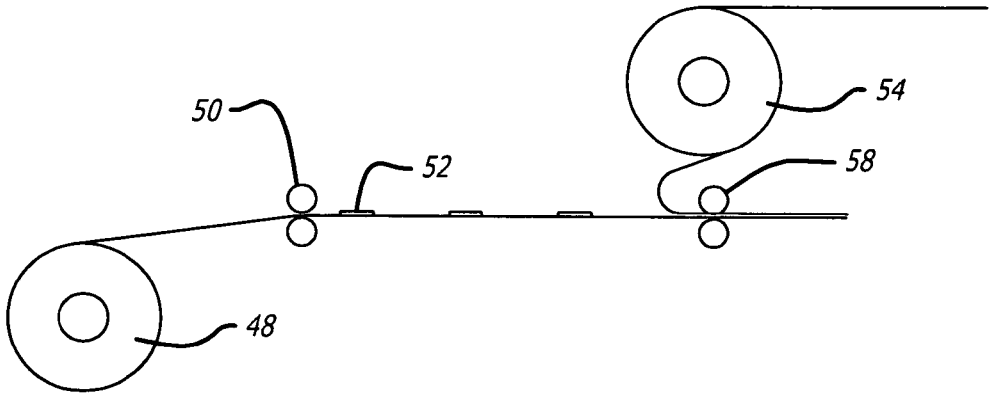
Figure 7:
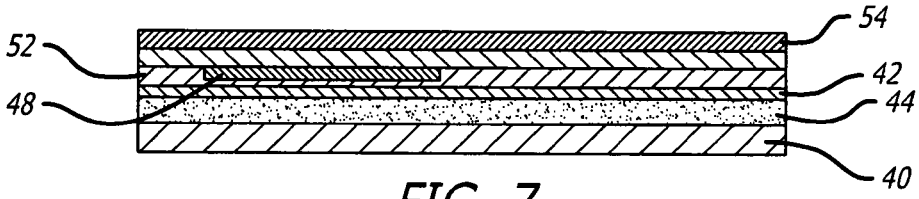

The next step in the first pass relates to embodiments or applications requiring peel-offs, or peel-tabs, where a two layer construction of base material may be required with a release coat. In FIG. 6, there is shown base material 48 on a roll, which unwinds and passes through a print station 50 which applies a release coat 52. A further roll of base material 54 unwinds, and passes through a pair of nip rollers 56, and is applied over the base material 48 to form a two-layer construction, seen in schematic cross-section in FIG. 7. There is shown in FIG. 7 the base material 48 face stock 42, including the adhesive 44, the face stock 42 of the base material 54 thereabove, and a release coat 52 therebetween.

Figure 8:
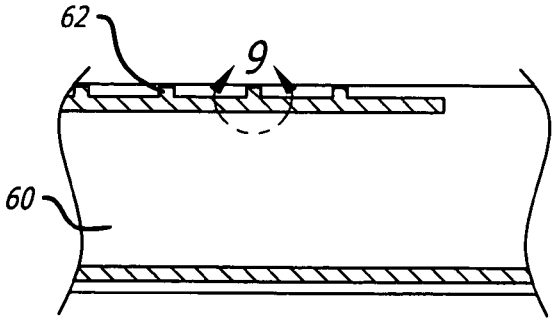
Figure 9:
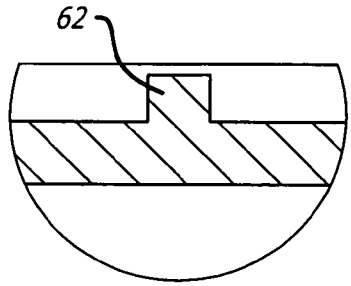

The third step of the first pass relates to printing, the printing comprising the desired or pre-selected material which will be shown on the label. Additionally, an "eye mark" must be printed on an area of the material. Note that the "eye mark" may be printed on a printed area, or a print-free area, either one being in order provided that it is consistent and capable of being identified and read by a sensor. The area in which the print of the "eye mark" occurs must be designated for the purposes of re-registration during the "second pass" described below. FIG. 8 shows a top view in schematic form of the base material 48, including printed matter 60 and a series of "eye marks" 62. FIG. 9 shows a close-up of one example only of an "eye mark" 62, and it should be understood that the "eye mark" 62 may be of any size, shape or form.

Figure 10:
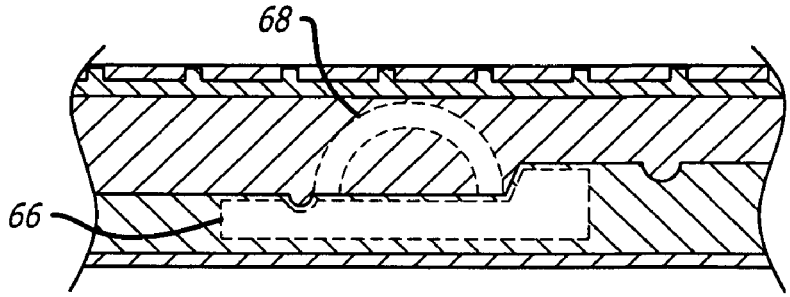

The fourth step in the first pass comprises the application of the release coat 52 layer on top of the printing/base stock 48, except for the area where the hanger will be adhered. See FIG. 10, a schematic representation showing the area where the varnish, or release coat area 64, is applied, and that area 66 where such varnish or release coat is not applied. The area 68 where the hanger will be applied is shown in phantom lines.

Figure 11:
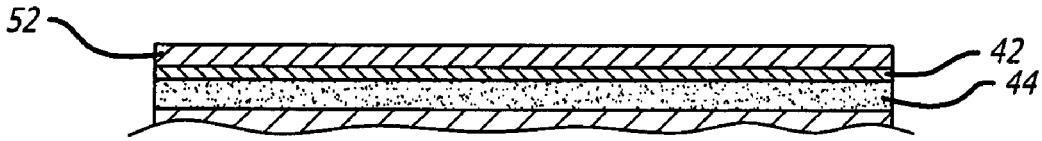

FIG. 11 shows a cross-section of the upper portion of the material, including the printing and release coat layer.

Figure 12:
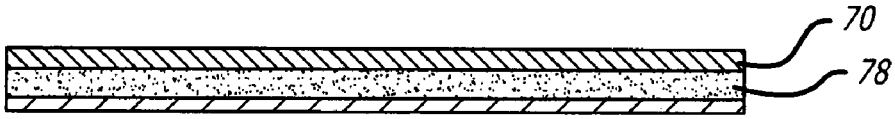
Figure 13:
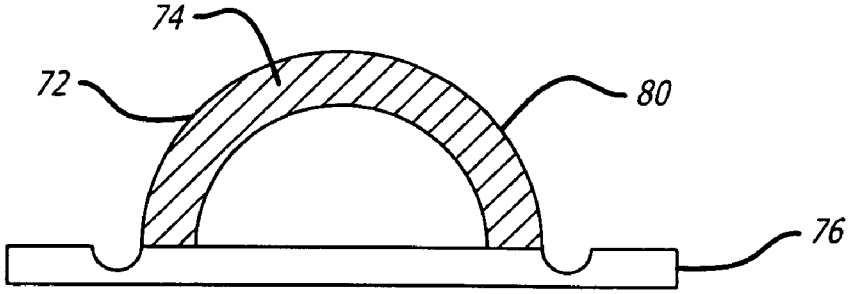
Figure 15:
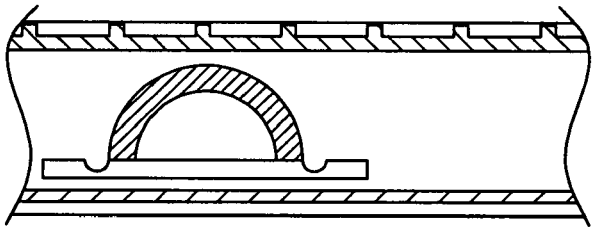

The next, or fifth step in the first pass relates to the use of an overlam material, typically a 5 mm clear overlam 70, for construction of a "hanger" 72, the hanger 72 comprising an arcuate hanging portion 74, and a connector strip 76. The hanger 72 is provided with an adhesive coat 78, but the top portion of the adhesive, or that part where the hanger will be, is coated with a varnish 80 so as to deaden or inactivate the adhesive. This permits this portion of the hanger to pulled away from the base material while the bottom portion of the hanger, or connector strip, will adhere strongly to the base material. FIG. 12 shows a cross-section of this arrangement, while FIG. 15 shows a schematic view of the hanging/hanger label, indicating that portion which has a deadening varnish, and that which does not.

Figure 14:
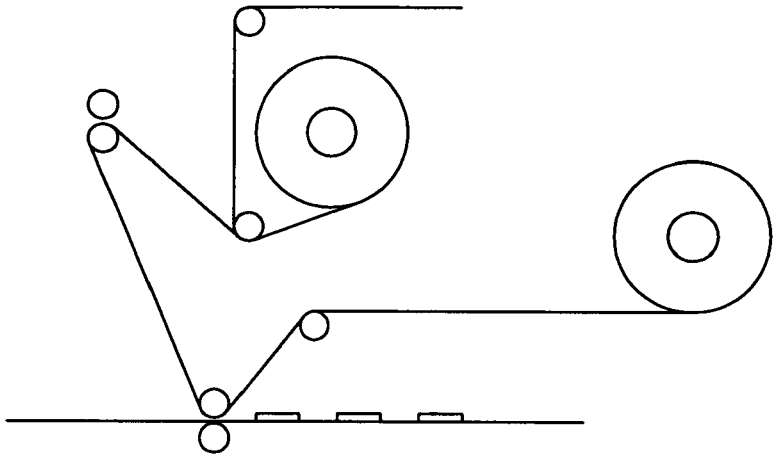
Figure 16:
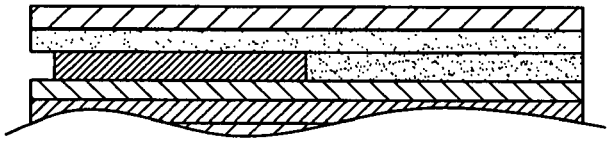

After a portion of the adhesive on the hanger has been deadened, as has been described above, the overlam 70 is die-cut to the shape of a hanger and all overlam waste is removed. Reference is made to FIG. 14 of the drawings, which shows some of the steps in this process. FIG. 15 is a top view showing the hanger placed on the material, while FIG. 16 shows a cross-section with the essential layers thereon.

Second Pass

The finished product from the first pass, which may also be referred to as the pre-printed material or stock, is inspected for defects, and the defects, where found, are removed, and the remainder of the pre-printed material spliced together for further processing, to be discussed below.

In the next or second step, the pre-printed stock or material is put back on the press, and passes through a re-registering system, which will time or calibrate the pre-printed stock with the "eye mark", or "eye mark sensor readable area", to match the speed and rotation of the press. By sensing the position and existence of the pre-printed "eye mark", the re-registering system will thus be provided with information to enable the tightening or loosening of the tension in the pre-printed stock, which is how the pre-printed stock is timed or calibrated during the second pass.

Figure 17A:
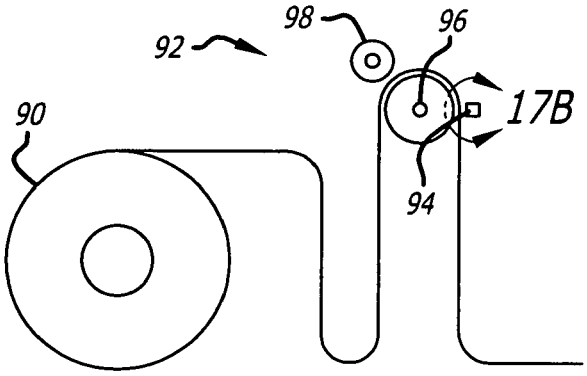
Figure 17B:
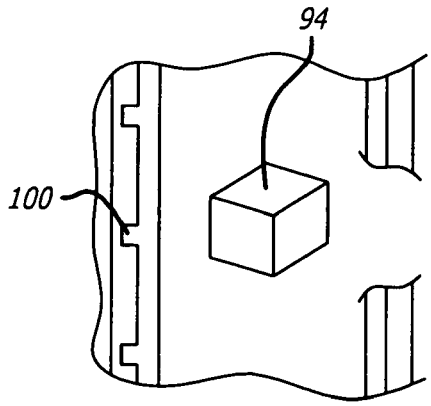

Reference is made to FIG. 17 of the drawings which shows the unwinding roll 90 of pre-printed stock and the re-registering system 92. A nip roller 94 operates in conjunction with a server motor 96 for the purpose of tightening or loosening the tension of the pre-printed material. The system shows the "eye mark" sensor 98, including a detail view thereof, the "eye mark" reader optically sensing or reading the pre-printed "eye mark" 100, as it has been printed on the pre-printed material or stock.

Figure 18:
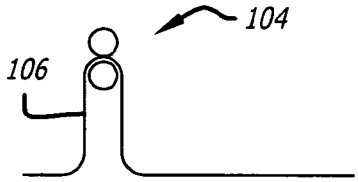
Figure 19:
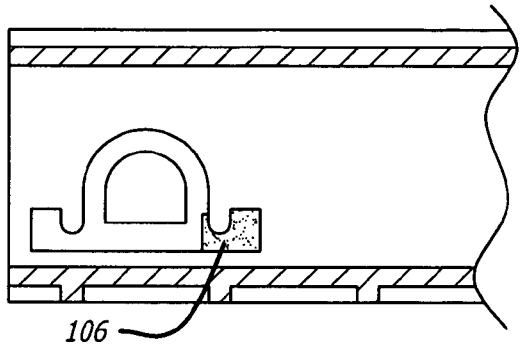

The re-registering system will allow for any additional printing, including the application of a "release coat" for the overlam application of the booklet. See FIGS. 18 and 19, showing the application of a release coat at a print station 104, through which the pre-printed stock 106 is fed. In FIG. 19, showing a close-up top view, a release coat, varnish area 106 is shown by shaded markings.

Figure 20:
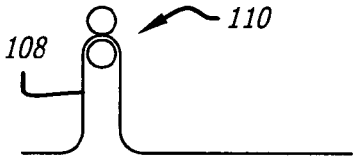
Figure 21:
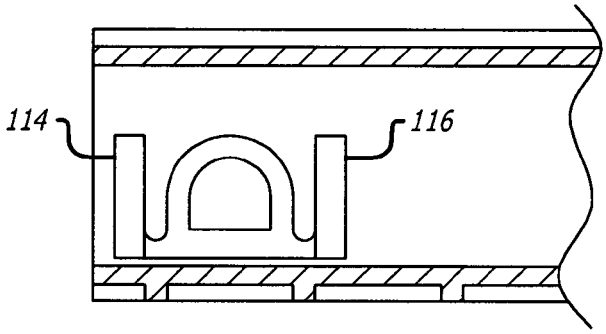

An alterative to the above is the printing of an adhesive area for the glued application of the booklet. Refer to FIGS. 20 and 21. FIG. 20 shows the pre-printed stock 108 passing through a print station 110 which applies adhesive, while FIG. 21 shows a close-up top view showing two vertical bars 114 and 116 of adhesive. This printing pattern of two vertical bars is just an example of a pattern which can be used, and any suitable area, or multiple points of adhesive, may be applied.

Figure 22:
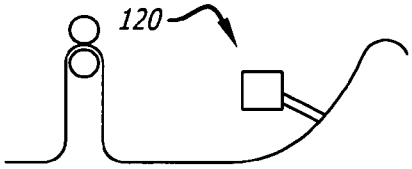
Figure 23:
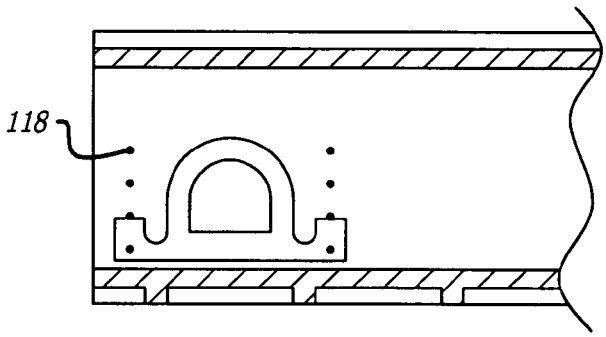

Alternatively, the re-registering system will also allow the dispensing of a glue/adhesive from a "gluing system", as shown in FIGS. 22 and 23 of the drawings. FIG. 22 shows examples of glue spots 118 applied from the gluing system 120.

Figure 24:
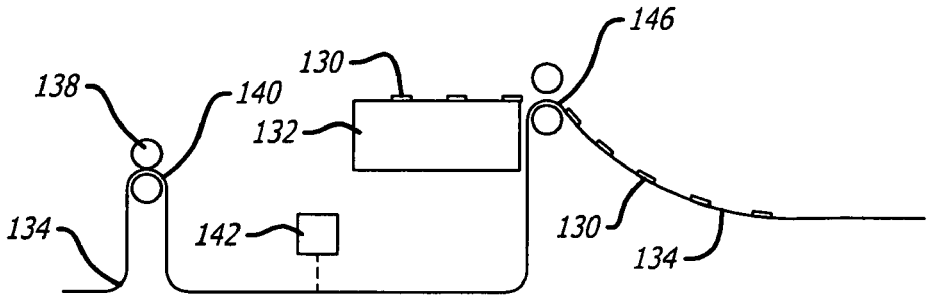

In the next or third step of the second pass, a booklet 130, such as a coupon, leaflet or insert, is now applied to the "pre-printed stock", using a booklet applicating system 132. This system is timed or calibrated to the speed and rotation of the press independently through an electronic encoder. The encoder has, in one embodiment, a mechanical gear which is attached to a gear sprocket or shaft of the printing press, where it receives its signal so as to match the speed and rotation of the press. A length, or repeat, is determined by the repeat of what will be the final printed label/product, and entered into the "booklet applicating system". This booklet applicating system 132 will now dispense a booklet 130 onto the pre-printed stock 134 at intervals of this determined repeat. See FIG. 24 of the drawings, showing the pre-printed stock 134 passing through a print station 138 where adhesive 140 is applied, or, alternatively, through a gluing system 142. Also shown is the booklet applicating systems, where a supply of booklets 130 is moved onto the pre-printed stock 134 through a nip or pinch-point 146, whereupon the booklets 130 are shown, applied by means of an adhesive or glue, on the pre-printed stock.

Figure 25:
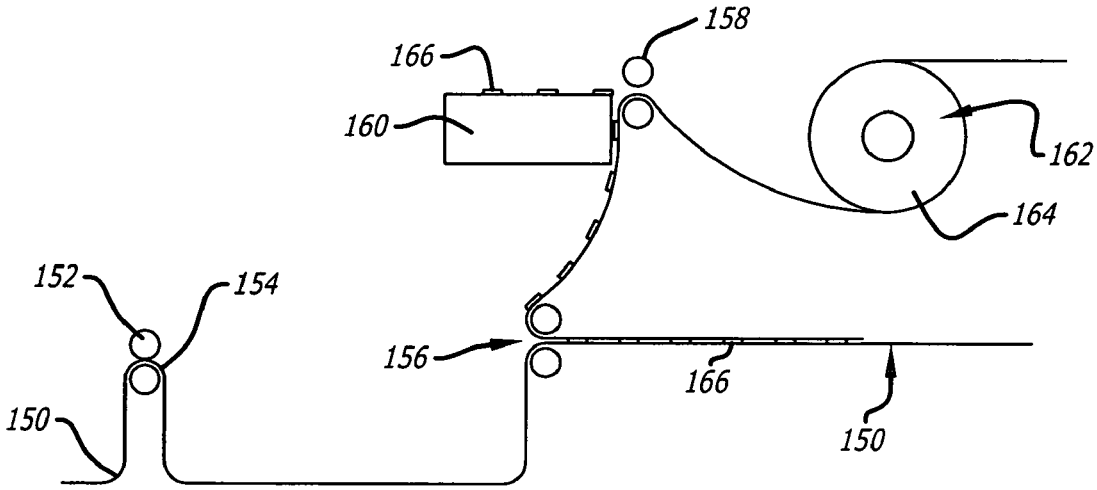

FIG. 25 shows a side view with the overlam application. Thus, the pre-printed stock 150 passes through a print station 152 which applies a release coat 154, whereupon it may, as an option, pass through a pre-arching mechanism 156, but this may not be necessary for all applications. The pre-printed stock 150 then passes through a nip roller 158, which is also supplied by the booklet applicating system 160. It will be seen from FIG. 25 that an overlam 162 unwinds from a roll 164, passes through nip rollers 158 adjacent a booklet applicating system 160, and the booklets 166 are applied to the overlam 162. At the point where the pre-printed stock 150 and the overlam 162 with the booklets applied thereto meet, at the nip roller 158, the two are put together, so that there is shown, at the bottom, the pre-printed stock, and the booklets thereon, with the overlam 162 over the booklets 160.

Figure 26:
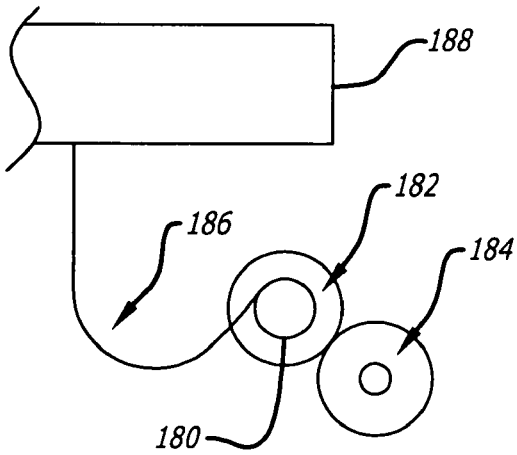

FIG. 26 shows a schematic view of the encoder 180. The encoder 180 is placed on an encoder gear 182, which is adjacent a press gear 184. Through an appropriate connection, such as a wire 186, input is fed to the booklet applicating system 188, so that the booklets can be applied in the appropriate spots or locations on the pre-printed stock. The encoder 180, sensor, encoding gear 182 and resulting proper location of the pre-printed stock in the press, ensures that the booklets are applied correctly over the pre-printed stock.

Figure 27:
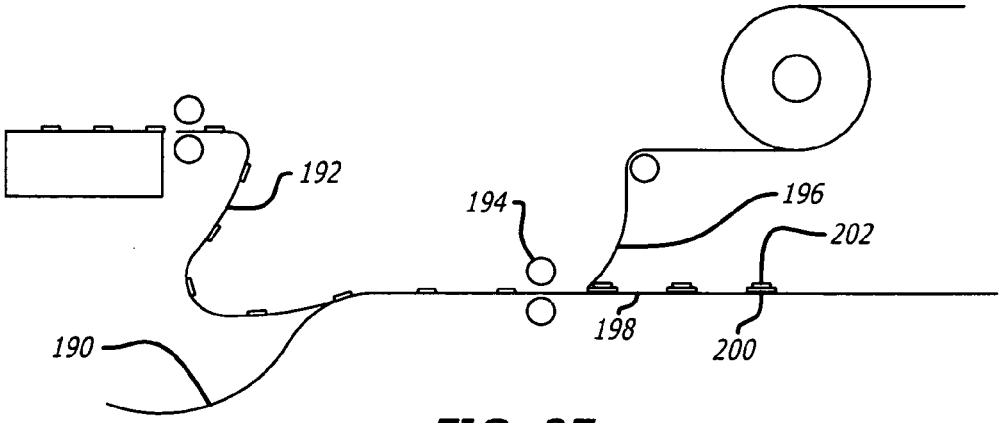

In the next or fourth step in this second pass, the pre-printed stock is then die-cut to its final shape and dimensions, and all waste is removed. This is shown schematically in FIG. 27 of the drawings. In FIG. 27, the pre-printed stock 190 and the overlam application 192 with booklets come together, where they are die-cut 194, and the waste 196 removed. The resulting product comprises the base liner 198 of pre-printed stock, the base label 200 with the hanger, and the booklet 202.

Figure 28:
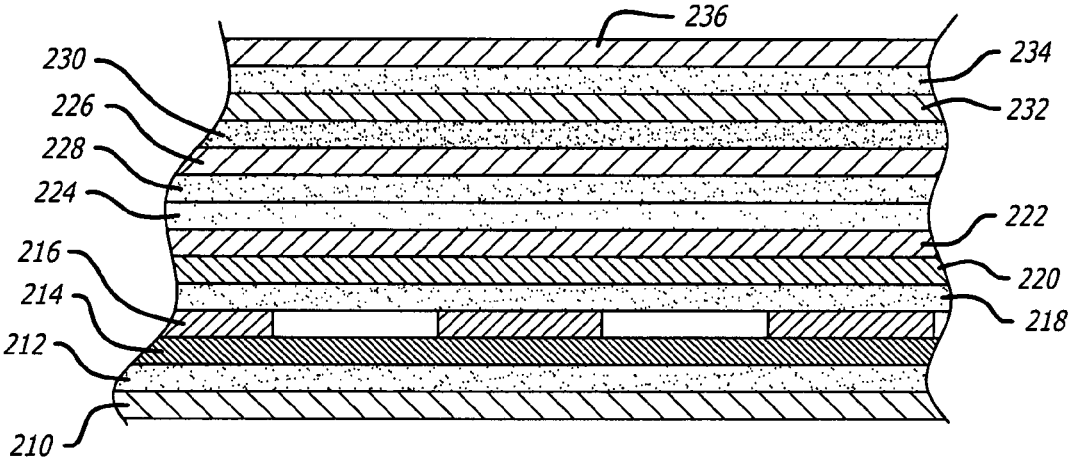

FIG. 28 of the drawings shows a schematic side view of the various layers involved in the final product. Starting from the bottom, there is a liner 210, upon which an adhesive 212 is formed, and over which the first base material 214 is placed. Thereabove, there is a release coat 216 for peel-tab, where used. An adhesive 218 is formed thereover.

Thereafter, there is a second layer 220 and a printing layer 222, including the "eye mark" on the release coat is formed thereon. This is followed by the adhesive deadening 224 for the overlam layer, upon which the overlam, preferably 5 mm hanger 226, is formed. On the adhesive 228 5 mm/film/hanger there is applied the overlam 226, followed by glue 230 for a glued application, or a release coat, on the base of the hanger, for the overlam application. Thereafter, the book 232 is formed, with the adhesive layer 234 thereon, and finally, the overlam 236 is placed on top.

Figure 29:
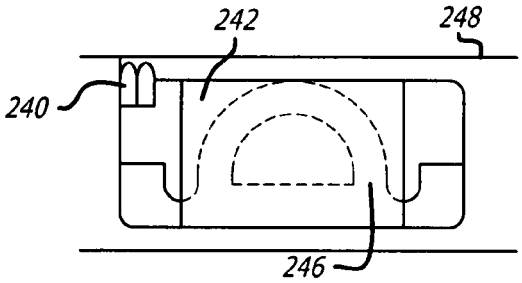
Figure 30:
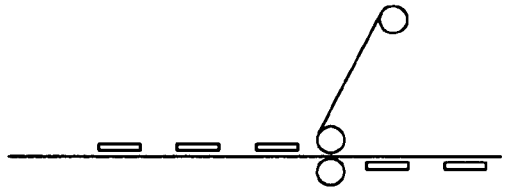

FIG. 29 shows a schematic view, including the removable peel-tabs 240 on the label, the booklet 242, the hanger portion 246, and the liner 248.

The invention is not limited to the details or specific embodiments described herein. These embodiments should be understood as examples of the scope of the invention. Many variations in both the procedure for making the labels or parts thereof as well as labels produced thereby, may be employed in accordance with the principles of the invention.

The invention claimed is:

1. A method of monitoring the position of a web roll of labels in a printing press machine having at least one gear, the method comprising:

forming a mark on each label on the web roll, the mark being at substantially the same position on each label on the web roll;

sensing the presence of the mark by means of a mark sensor at a predetermined location;

sensing the position of the at least one gear by means of a speed sensor to determine the speed at which the web roll of labels is moving through the printing press machine; and monitoring and adjusting where necessary the speed of the web roll as it moves through the printing press by co-ordinating the information received from the mark sensor and the speed sensor so that a label on the web roll will be properly positioned at a selected station of the printing press machine for attachment of a device to the label at the station.

2. A method as claimed in claim 1 wherein the device attached to the label at the station comprises a booklet.

3. A method as claimed in claim 1 wherein the mark comprises a solid dark indicator printed on the label and the mark sensor comprises an optical sensor for sensing the presence of the indicator.

4. A method as claimed in claim 1 wherein the speed sensor measures the rate of rotation of the gear, and the method further comprises calculating the speed of the movement of the web roll through the printing press machine based on the speed of rotation of the gear.

5. A method as claimed in claim 4 wherein the speed sensor and gear comprise an electronic encoder.

6. A method as claimed in claim 1 wherein the speed sensor is connected to a booklet applicator system, and the booklet applicator system dispenses booklets for attachment to the label when the web roll is properly positioned so that the booklet is located on the label in a predetermined position.

7. A method as claimed in claim 6 further comprising the step of placing glue or adhesive on the label for attaching the booklet to the label in the predetermined position.

8. A method as claimed in claim 7 further comprising placing a release layer over at least a portion of the adhesive.

9. A method as claimed in claim 1 wherein the monitoring and adjusting includes slowing down or increasing the speed of the web roll as it moves through the printing press machine in response to information obtained from the mark sensor or the speed sensor.

10. A method as claimed in claim 1 further comprising the step of placing a hanger on the label prior to attachment of the device to the label, the hanger comprising a connector strip fastened to the label and a hanger portion attached to the connector strip but not directly to the label.

11. A method as claimed in claim 1 wherein the device is a booklet and the method comprises the step of arching the booklet on the label to account for curvature of a bottle on which the label may be mounted.

12. A method as claimed in claim 1 comprising an encoder gear operatively connected to the at least one gear, the encoder gear comprising the speed sensor to determine the speed of the web roll.

13. A system for monitoring the position of a web roll of labels in a printing press machine having at least one gear, the system comprising:

a mark formed on each label on the web roll, the mark being at substantially the same position on each label on the web roll;

a mark sensor at a predetermined location along the printing press machine for sensing the presence of the mark;

a speed sensor for sensing the position of the at least one gear to determine the speed at which the web roll of labels is moving through the printing press machine; and a control member for monitoring and adjusting where necessary the speed of the web roll as it moves through the printing press by co-ordinating the information received from the mark sensor and the speed sensor so that a label on the web roll will be properly positioned at a selected station of the printing press machine for attachment of a device to the label at the station.

14. A printing press machine for processing a web roll of labels, the printing press machine comprising:

a mark sensor at a predetermined location along the printing press machine for sensing the presence of a mark formed on each label on the web roll, the mark being at substantially the same position on each label on the web roll;

a speed sensor for sensing the position of at least one gear on or associated with the printing press machine to determine the speed at which the web roll of labels moves through the printing press machine; and a control member for monitoring and adjusting where necessary the speed of the printing press machine so as to regulate the speed of the web roll as it moves through the printing press by co-ordinating the information received from the mark sensor and the speed sensor so that a label on the web roll will be properly positioned at a selected station of the printing press machine for attachment of a device to the label at the station.

15. A printing press machine as claimed in claim 14 further comprising a booklet applicator for dispensing and applying a booklet to the label on the web roll when properly positioned at the selected station.

16. A printing press machine as claimed in claim 15 further comprising an adhesive dispenser for dispensing adhesive to the label on the web roll, the adhesive facilitating adhesion of the booklet to the label.

17. A printing press machine as claimed in claim 16 further comprising a hanger station for applying a hanger to the label on the web roll prior to application of the booklet.

18. A printing press machine as claimed in claim 14 wherein the speed sensor measures the rate of rotation of the gear for calculating the speed of the movement of the web roll through the printing press machine based on the speed of rotation of the gear.

19. A printing press machine as claimed in claim 14 comprising an encoder gear operatively connected to the at least one gear, the encoder gear comprising the speed sensor to determine the speed of the web roll.

20. A printing press machine for applying a booklet to a label on a web roll of labels, the printing press machine comprising:

a mark sensor at a predetermined location along the printing press machine for sensing the presence of a mark formed on each label on the web roll, the mark being at substantially the same position on each label on the web roll;

a speed sensor for sensing the position of at least one gear on or associated with the printing press machine to determine the speed at which the web roll of labels moves through the printing press machine;

a booklet applicator for dispensing and applying a booklet to the label on the web roll; and a control member for monitoring and adjusting where necessary the speed of the printing press machine so as to regulate the speed of the web roll as it moves through the printing press by co-ordinating the information received from the mark sensor and the speed sensor so that a label on the web roll will be properly positioned at a selected station of the printing press machine for attachment of a booklet to the label at the station.

* * * * *